US007549184B2

(12) United States Patent
Zhang

(10) Patent No.: US 7,549,184 B2
(45) Date of Patent: Jun. 23, 2009

(54) ADDING LIQUID MACHINE WITH PRESETTABLE QUANTITY AND ADDING LIQUID METHOD THEREOF

(75) Inventor: Yu-Gao Zhang, Wanchai (CN)

(73) Assignee: Esquel Enterprises Limited, Wanchai (HK)

( * ) Notice: Subject to any disclaimer, the term of this patent is extended or adjusted under 35 U.S.C. 154(b) by 540 days.

(21) Appl. No.: 10/555,823

(22) PCT Filed: Aug. 5, 2004

(86) PCT No.: PCT/CN2004/000904

§ 371 (c)(1),
(2), (4) Date: Nov. 7, 2005

(87) PCT Pub. No.: WO2006/012776

PCT Pub. Date: Feb. 9, 2006

(65) Prior Publication Data

US 2006/0272101 A1 Dec. 7, 2006

(51) Int. Cl.
*D06F 39/02* (2006.01)
*D06F 29/00* (2006.01)

(52) U.S. Cl. ..... 8/159; 68/12.18; 68/17 R; 68/23.5; 68/207

(58) Field of Classification Search ..... 68/12.18, 68/17 R, 18 R, 23 R, 23.5, 24, 58, 207
See application file for complete search history.

(56) References Cited

U.S. PATENT DOCUMENTS 3,546,904 A * 12/1970 Horst ..... 68/16
4,080,165 A 3/1978 Thompson
6,030,697 A 2/2000 Samson et al.
2003/0213069 A1* 11/2003 Tortorici et al. ..... 8/158
2005/0183208 A1* 8/2005 Scheper et al. ..... 8/142

FOREIGN PATENT DOCUMENTS

| | | | |
|---|---|---|---|
| CN | 2146500 | Y | 11/1993 |
| CN | 1203064 | A | 12/1998 |
| DE | 3413967 | A1 * | 10/1985 |
| DE | 3701 118 | | 7/1988 |
| EP | 1 215 329 | A2 | 6/2002 |
| GB | 2 127 045 | A | 4/1984 |
| WO | PCT/CN2004/000904 | | 8/2004 |

OTHER PUBLICATIONS

Electronic translation of DE 3701118.*
Electronic translation of DE 3413967.*

* cited by examiner

*Primary Examiner*—Joseph L Perrin
(74) *Attorney, Agent, or Firm*—Van Dyke, Gardner, Linn & Burkhart LLP

(57) ABSTRACT

An adding liquid machine with presettable quantity and a method of adding a right amount of liquid includes a washer extractor, on which a spray apparatus which sprays chemicals on the garment therein is provided; a first measuring apparatus placed on an adding chemicals container for measuring the chemicals contained in the adding chemicals container. The adding chemicals tank is connected fluidly with the spray apparatus through the first chemical pump. The method includes setting a wet pick up ratio and a bath liquid ratio; determining the chemicals amount to be added based on the garment quantity and the set wet pick up; pumping the determined amount of chemicals into the washer extractor, and rotating the inner-drum in the washer extractor to immerse the garment; and extracting surplus chemicals in the clothing. When the extracted surplus chemicals amount reaches the value calculated by the set wet pick up ratio, the extracting will be stopped.

21 Claims, 4 Drawing Sheets

ADDING LIQUID MACHINE WITH PRESETTABLE QUANTITY AND ADDING LIQUID METHOD THEREOF

FIELD OF THE INVENTION

The present invention relates to an adding liquid machine with presettable quantity and an adding liquid method thereof, more specially, to an adding liquid machine with presettable quantity capable of making the garment have a function of anti-wrinkle, dye, ironing-out, hardening and so on by the garment absorbing a right amount of chemicals, such as resin during the process of anti-wrinkling and an adding liquid method thereof.

BACKGROUND OF THE INVENTION

One object being pursued by people is that the clothing material can have a function of anti-wrinkle, dye, ironing-out and hardening and so on while it keeps comfortable. At present, one conventional method is to make the clothing have a characteristic of anti-wrinkle, dye, ironing-out, hardening and so on by the clothing absorbing a right amount of chemicals, such as resin. In prior art, in order to aim at the above processing of anti-wrinkle, dye, ironing-out, hardening and so on, there is mainly included the following ways: one immersing chemicals method is to put the clothing into a tank with a quantity of chemicals, and immerse the clothing in the chemicals about 20 to 30 minutes; by being held it into a bag net, the air received in the clothing must be discharged off so that the chemicals can be absorbed completely by the clothing, then the clothing is hung up and placed over the tank about a certain time. At last, the clothing is put into the washer extractor to extract water therefrom such that the absorbed water ratio reaches a set value. However, one disadvantage of the above-mentioned method is that it cannot control the amount of the absorbed chemicals accurately, and not recycle the chemicals, so it not only wastes chemicals, but also pollutes the environment.

Another spraying chemicals method is to put the clothing into a spraying chemicals machine and keep the clothing rotated, a pump with pressure in the spraying chemicals machine is controlled to spray the resin solution onto the clothing through a nozzle, thereby making the garment have a function of anti-wrinkle, dye, ironing-out, hardening and so on. A right quantity of required chemicals can be measured and pre-determined accurately against the weight of garment. The absorbent percentage of chemical in that particular circle is totally accurate. Since there is not chemical extraction process, then there is no wastage at all. Moreover, unevenness of chemical absorption in different pieces of garment is still appeared in the same processes of spraying chemicals. The unevenness appeared in thicker parts will become more obvious. High wet pick up will be required (usually approach 100%). The liquid absorbing should be in a "saturated" position to allow liquid "transfer". And such high water contained will require long time in tumbler dry.

SUMMARY OF THE INVENTION

To solve the problem described above, in accordance with one aspect of the present invention, there is provided an improved device for adding liquid with presettable quantity which can perform anti-wrinkle, dye, ironing-out and hardening process on the garment, and an adding liquid method thereof, in which the chemicals for anti-wrinkle, dye, ironing-out and hardening can be sprayed on the garment evenly when the garment is kept rotating in the washing machine.

In accordance with one further aspect of the present invention, there is provided an improved adding liquid machine with presettable quantity and an adding liquid method thereof, in which surplus chemicals can be drawn back to reuse.

In order to achieve the above and other objects, there is provided an improved adding liquid machine with presettable quantity, including a washer extractor, a spray apparatus which sprays chemicals on the garment therein is provided on said washer extractor; a first measuring apparatus which is placed on an adding chemicals container, for measuring the chemicals contained in said adding chemicals container; wherein said adding chemicals container is connected fluidly with said spray apparatus through a first chemical pump.

In said adding liquid machine with presettable quantity, said adding chemicals container is connected fluidly with a large capacity chemicals tank.

In said adding liquid machine with presettable quantity, a drainpipe in said washer extractor is connected fluidly with said adding chemicals tank.

In said adding liquid machine with presettable quantity, said drainpipe is connected fluidly with a surplus chemicals tank disposed on the second measuring apparatus, and said surplus chemicals tank is connected fluidly with said adding chemicals tank.

In said adding liquid machine with presettable quantity, said first and second measuring apparatus are electronic scale.

In said adding liquid machine with presettable quantity, said surplus chemicals tank is connected fluidly with said adding chemicals tank through a third chemicals pump.

In said adding liquid machine with presettable quantity, said large capacity chemicals tank is connected fluidly with said adding chemicals tank through the second chemicals pump.

In said adding liquid machine with presettable quantity, a platform which can place the garment to be washed thereon is provided on said adding chemicals tank so that the first measuring apparatus can measure on the garment.

In said adding liquid machine with presettable quantity, said first measuring apparatus includes a first microprocessor, said first microprocessor can calculate the chemicals amount to be sprayed inside the washer extractor based on the measured garment quantity and the predetermined bath liquid ratio.

In said adding liquid machine with presettable quantity, the chemicals amount discharged from the washer extractor can be calculated by subtracting the chemicals amount absorbed by the garment which was calculated based on the wet pick up ratio from the chemicals total amount added therein.

In said adding liquid machine with presettable quantity, the washing speed and the extracting speed of said washer extractor are adjustable.

In said adding liquid machine with presettable quantity, said washing/extracting speed of said washer extractor is within a range from 30/60 to 360/700 rpm.

In accordance with another aspect of the present invention, there is provided a method of adding a right amount of liquid into the adding liquid machine with presettable quantity including a washer extractor, a spray apparatus which sprays chemicals on the garment therein is provided on said washer extractor; a first measuring apparatus which is placed on an adding chemicals container, for measuring the chemicals contained in said adding chemicals container; wherein said adding chemicals tank is connected fluidly with said spray apparatus through a first chemical pump; said method includes the steps of:

Setting a wet pick up ratio representing the chemicals amount to be absorbed by the garment and a bath liquid ratio representing the chemicals amount to be added into the washer extractor;

Determining the chemicals amount added into the washer extractor based on the garment quantity and the set wet pick up ratio;

Pumping the chemicals of which the amount has been determined in the step (b) into the washer extractor, keeping the inner-drum in the washer extractor to rotate a predetermined time, and starting to immerse the garment in the washer extractor;

Keeping the inner-drum in the washer extractor to rotate at high speed such that the centrifugal force produced at the high speed rotary can extract the surplus chemicals in the clothing, when the extracted surplus chemicals amount reaches the value calculated by the set wet pick up ratio, the extracting will stop.

In said method of adding a right amount of liquid, the method further includes: in step (b), said first measuring apparatus measures the weight of said clothing, and determines the required chemicals amount to be filled in the machine automatically based on the set wet pick up ratio.

In said method of adding a right amount of liquid, wherein the surplus chemicals amount extracted from said washer extractor can be calculated by subtracting the chemicals amount absorbed by the garment which was calculated based on the wet pick up ratio from the chemicals total amount added therein.

In said method of adding a right amount of liquid, the method further includes the step of discharging the surplus chemicals extracted from the machine into the adding chemicals container.

In said method of adding a right amount of liquid, wherein the determined chemicals amount to be filled in the machine in the step (b) contains the chemicals discharged from the surplus chemicals tank into the adding chemicals tank during the adding a right amount liquid last time.

In said method of adding a right amount of liquid, wherein the inner-drum in said washer extractor can rotate alternately in forward and backward direction in the step (c).

In accordance with further aspect of the present invention, there is provided a method of adding a right amount of liquid into the adding liquid machine with presettable quantity including a washer extractor, a spray apparatus which sprays chemicals on the garment therein is provided on said washer extractor; a first timer which is provided to compute the time of adding chemicals into the said washer extractor; wherein said adding chemicals tank is connected fluidly with said spray apparatus through a first chemical pump; said method includes the steps of:

(a') Setting the values of wet pick up ratio representing the chemicals amount absorbed by the garment and the bath liquid ratio representing the chemicals amount to be added into the washer extractor;

(b') Determining the time of adding the chemicals into the washer extractor based on the garment quantity and the set wet pick up ratio;

(c') Pumping the chemicals from the adding chemicals tank into the washer extractor, when the time of adding the chemicals reaches the determined time in the step (b), the procedure of adding the chemicals will be stopped, then the rotary inner-drum in the washer extractor will run at the set time to make the clothing immerse in the machine;

(d') Keeping the inner-drum in the washer extractor to rotate at high speed such that the centrifugal force produced at the high speed rotary can extract the surplus chemicals in the clothing, when the time of extracting reaches the value calculated by the set wet pick up ratio, the extracting will be stopped.

The principle of the adding liquid machine with presettable quantity and the adding liquid method thereof according to the present invention is to immerse the clothing in the chemicals that is far above the absorbing amount, and ensure the clothing wet by means of rotating. And then the centrifugal force can extract the chemicals in the clothing. When the extracted chemicals amount is equal to the set value, the machine will stop the high speed rotation. In this way, it can attain the effect of making each garment absorb the chemicals evenly, and making the chemicals immerse evenly, moreover the surplus chemicals can be drawn back to reuse, so it is possible to save the energy, and prevent from polluting the environment.

BRIEF DESCRIPTION OF THE DRAWINGS

The object and the conception of the present invention will become apparent from the following description of the preferred embodiments with reference to the attached drawings, in which.

DESCRIPTION OF THE PREFERRED EMBODIMENTS

The specific embodiments of the present invention will hereinafter be described in details by reference to the attached drawings, which illustrate examples of the present invention, in which similar components are denoted by the same reference numbers.

Figure 1:
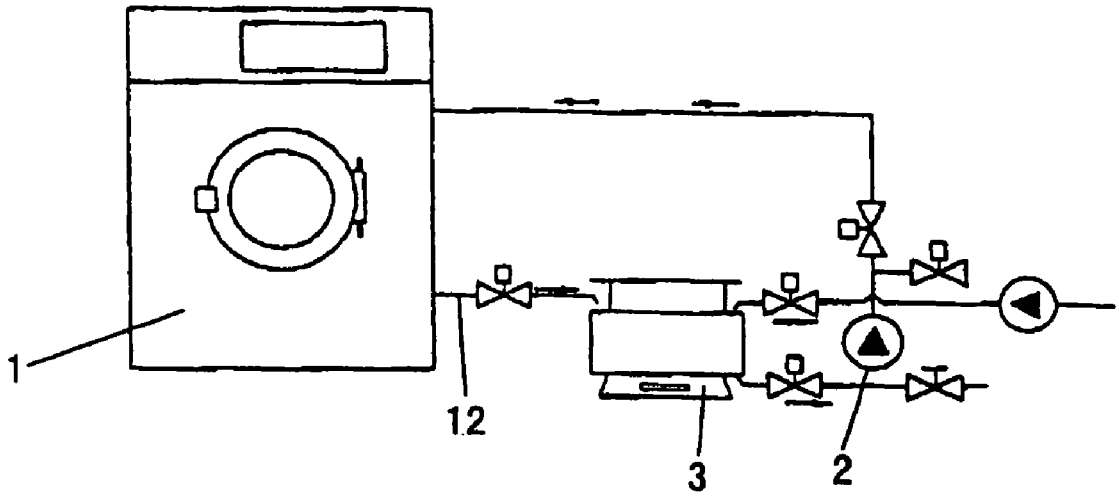
FIG. 1 is a view illustrating the configuration and working principle of the adding liquid machine with presettable quantity according to the first embodiment of the present invention.
Figure 4:
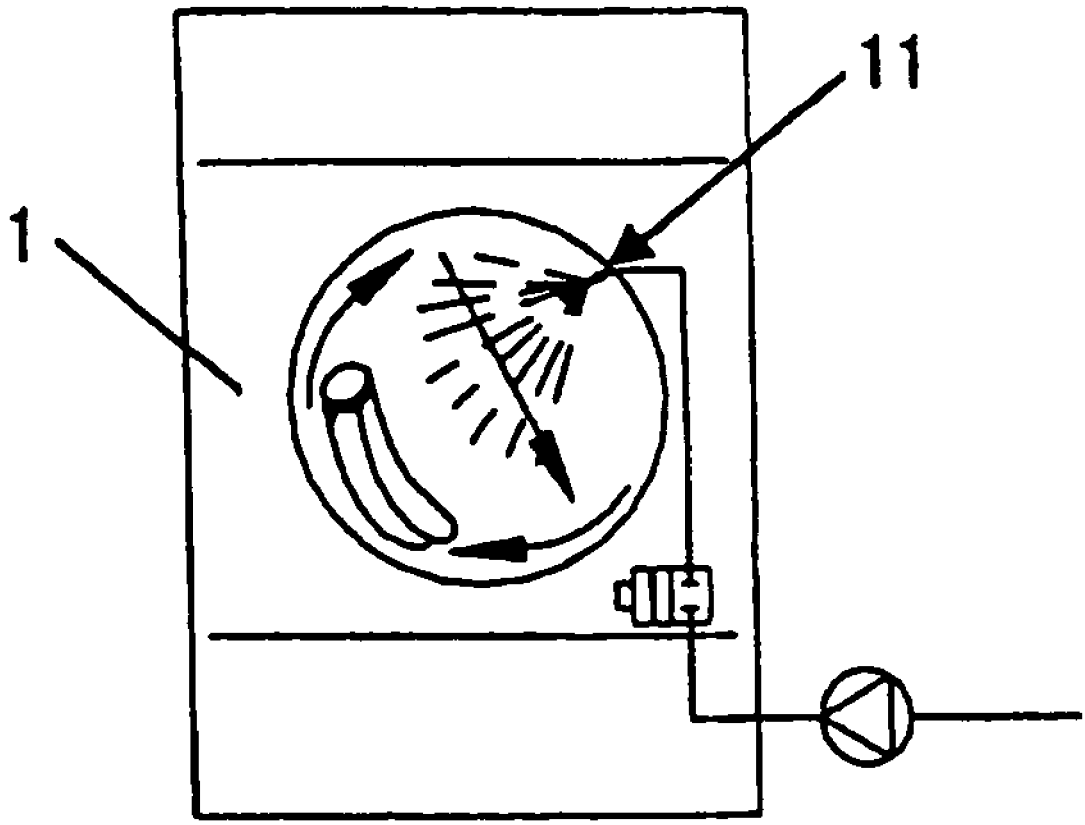
FIG. 4 is perspective view schematically showing the chemicals being sprayed into the machine, when the inner-drum in the washer extractor is rotating.

First, by referring to FIGS. 1 and 4, FIG. 1 is a view illustrating the configuration and working principle of the adding liquid machine with presettable quantity according to the first embodiment of the present invention. The adding liquid machine with presettable quantity includes a washer extractor 1, a spray apparatus which sprays chemicals on the garment therein is provided on the washer extractor 1, preferably, the spray apparatus is a spray nozzle 11, which sprays the chemicals on the garment evenly, the spray nozzle 11 is preferably arranged on the cover of an inner-drum; a first measuring apparatus which is placed on an adding chemicals tank 4 for measuring the chemicals contained in the adding chemicals tank 4; wherein said adding chemicals tank 4 is connected with the spray apparatus in the fluid ways through the first chemical pump 2.

Figure 2:
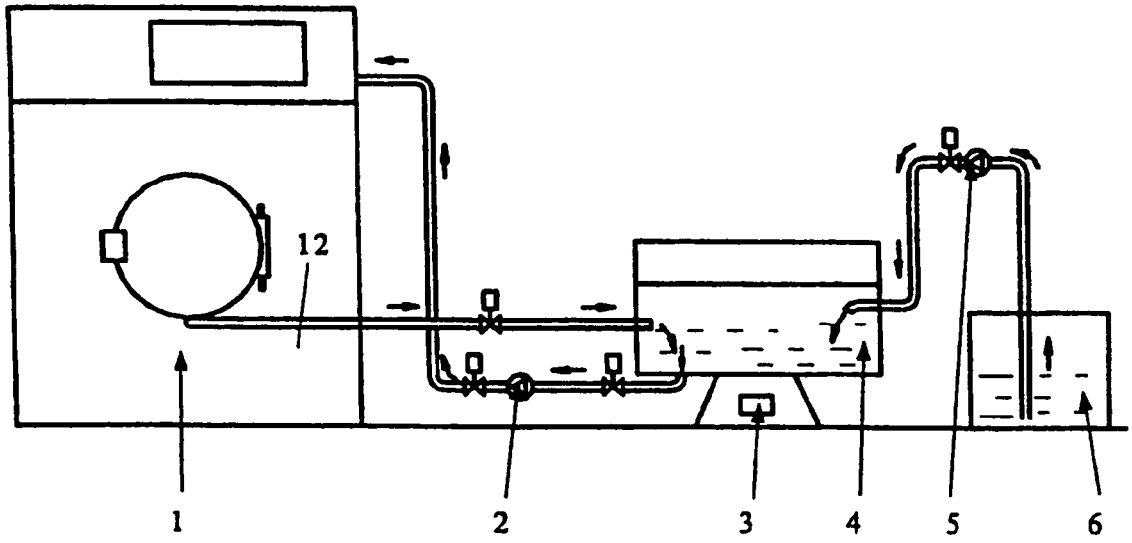
FIG. 2 is a view illustrating the configuration and working principle of the adding liquid machine with presettable quantity according to the second embodiment of the present invention.

Further, FIG. 2 is a view illustrating the configuration and working principle of the adding liquid machine with presettable quantity according to the second embodiment of the present invention. In said adding liquid machine with presettable quantity of the present invention, the adding chemicals tank 4 is connected fluidly with a large capacity chemicals tank 6, a drainpipe 12 in the washer extractor 1 is connected fluidly with the adding chemicals tank 4. In the adding liquid machine with presettable quantity, the first measuring apparatus can measure the chemicals contained in the adding chemicals tank 4, preferably, it is an electronic scale 3, but it also may be a liquidometer for detecting and measuring the liquid level of the chemicals contained in the adding chemicals tank 4, or may be a pressure gauge.

Preferably, a second chemicals pump 5 is installed on a pipeline which connects the large capacity chemicals tank 6 with the adding chemicals tank 4, and a valve can be fixed on one end of the second chemicals pump 5 such that it can control the chemicals amount flowing from the chemicals tank 6 into the adding chemicals tank 4. Also, a valve can be fixed on one end of the first chemicals pump 2 to control the chemicals amount flowing from the surplus chemicals pump 4 into the washer extractor 1.

In operation, the chemicals contained in the large capacity chemicals tank 6 are pumped into the adding chemicals tank 4 through the second chemicals pump 5, and the adding chemicals amount can be measured and controlled by the electronic scale 3, and then the chemicals in the adding chemicals tank 4 are pumped into the machine 1 through the first chemicals pump 2, after the clothing in the machine are washed and extracted, the surplus chemicals are discharged into the adding chemicals tank 4, thereby one washing and extracting cycle has been finished. In this way, since the reflowed chemicals can be reused in the next chemicals cycle, it is possible to improve the utilization efficiency of the chemicals, and save the raw material.

As one improvement of the second embodiment of said adding chemicals machine with presettable quantity, a platform which can place the garment to be wished is provided on the adding chemicals tank 4 so that the first electrical scale 3 can measure the weight of the garment, and the resultant data of the measured are stored for stand by application. Moreover, the first electrical scale 3 includes a first microprocessor, said first microprocessor can calculate the chemicals amount to be sprayed inside the washer extractor based on the measured garment quantity and the predetermined bath liquid ratio, and further control the chemicals amount flowing from the chemicals tank 6 into the adding chemicals tank 4 through the second chemicals pump 5. Alternatively, said first microprocessor in the electric scale 3 may also calculate the chemicals amount to be sprayed inside the washer extractor based on the garment quantity input by manual work and the predetermined bath liquid ratio, and further control the chemicals amount flowing from the chemicals tank 6 into the adding chemicals tank 4 through the second chemicals pump 5. In the embodiment of said adding liquid machine with presettable quantity, said washing/extractor speeds of said washer extractor are adjustable, and within a range from 30/60 to 360/700 rpm.

Figure 3:
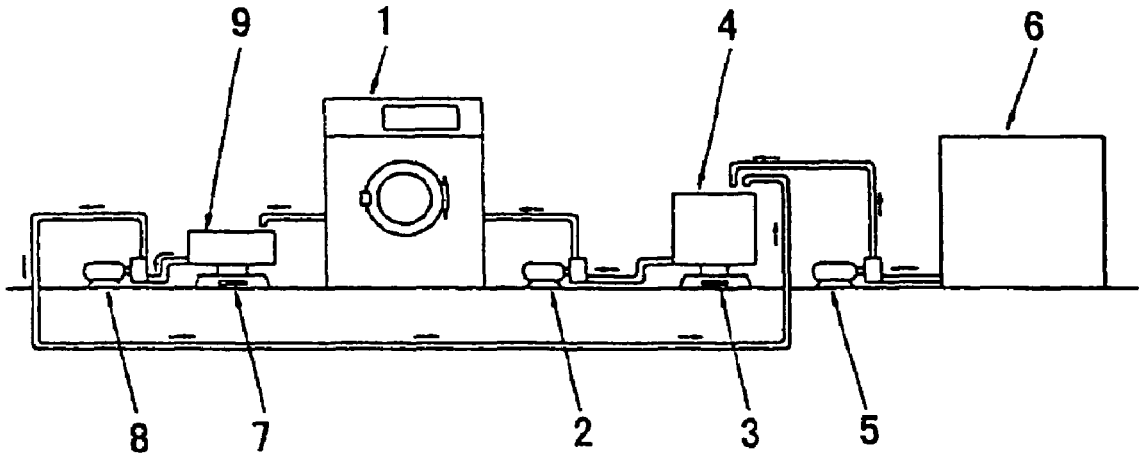
FIG. 3 is a view illustrating the configuration and working principle of the adding liquid machine with presettable quantity according to the third embodiment of the present invention.

FIG. 3 is a view illustrating the configuration and working principle of the adding liquid machine with presettable quantity according to the third embodiment of the present invention. As shown FIG. 3, a drainpipe 12 is not directly connected with the adding chemicals tank 4 through the pipeline, but is connected fluidly with the surplus chemicals tank 9 disposed on the second measuring apparatus, the surplus chemicals tank 9 is further connected fluidly with the adding chemicals tank 4. In one preferred aspects, the surplus chemicals tank 9 is connected fluidly with the adding chemicals tank 4 through the third chemicals pump 8, and the second measuring apparatus is preferably a electric scale 7, it may be a liquidometer, pressure gauge or any other measuring apparatus suitable for measuring the chemicals contained in the surplus chemicals tank 9. In the third embodiment of said adding liquid machine with presettable quantity, the chemicals amount discharged from the washer extractor 1 can be calculated by subtracting the chemicals amount absorbed by the garment which was calculated based on the wet pick up ratio from the chemicals total amount added therein.

Next, a method of adding a right amount of liquid into the adding liquid machine with presettable quantity will be explained by a specific illustration.

One method of adding a right amount of liquid into the adding liquid machine with presettable quantity according to the present invention includes the steps:

First, setting step (a), that is, weighting or estimating the garment by the first measuring apparatus or other scales, and putting the garment into the washing extractor, then setting the value of wet pick up ratio representing the chemicals amount to be absorbed by the garment and the bath liquid ratio representing the chemicals amount added into the washer extractor, and starting the machine.

Next, in the measuring step (b), that is, determining the chemicals amount to be added into the washer extractor and the value of the first measuring apparatus corresponding to the adding chemicals amount based on the garment quantity weighted by the first measuring apparatus or the garment quantity inputted by manual work, and the garment bath liquid ratio. For example, if the garment quantity is 50 kg, and the required wet pick up is 50 percent, that means chemicals to be absorbed by the garment will be 50×50%=25 Kg, at the same time, calculating the chemicals amount to be filled in the adding chemicals tank 4 according to the bath liquid ratio, for example, if the bath liquid ratio is 1:3, thus the chemicals amount to be filled in the machine is 50 kg×3=150 Kg, weighting the chemicals amount to be filled in the adding chemicals tank 4 by the first electric scale 3 until reaching the value of the predetermined amount, such as 150 Kg.

As the first microprocessor of the first electric scale 3 in the first measuring apparatus, it can automatically compute the chemicals amount to be sprayed into the washer extractor based on the weighted garment quantity and the predetermined bath liquid ratio, thereby control the chemicals amount flowing from the chemicals tank 6 into the adding chemicals tank 4 through the second chemicals pump 5. Alternatively, said first microprocessor in the electric scale 3 may also compute the chemicals amount to be sprayed into the washer extractor based on the garment quantity input by manual work and the predetermined bath liquid ratio, and thereby control the chemicals amount flowing from the chemicals tank 6 into the adding chemicals tank 4 through the second chemicals pump 5.

Preferably, in the measuring step (b), the determined chemicals amount to be filled in the washer extractor contains the chemicals discharged from the surplus chemicals tank 9 into the adding chemicals tank during the adding a right amount liquid last time. That is to say, before adding the liquid with right amount every time, the chemicals discharged back from the washer extractor after adding chemicals with right amount last time may be stored in the adding chemicals tank 4, at this time, the chemicals amount flowing from the chemicals tank 6 into the adding chemicals tank 4 should be equal to the value of subtracting the chemicals amount discharged from the surplus chemicals tank 9 into the adding chemicals tank during the adding the liquid with right amount last time from the chemicals amount to be filled in the washer extractor, that is:

The chemicals amount flowing from the chemicals tank into the adding chemicals tank=the chemicals amount to be filled in the washer extractor−the chemicals amount discharged from the surplus chemicals tank 9 into the adding chemicals tank during the adding the liquid with right amount last time (1)

For example, if the chemicals amount to be filled in the washer extractor is 150 Kg, and the chemicals amount discharged from the surplus chemicals tank 9 into the adding chemicals tank during the adding the liquid with right amount last time is 120 Kg, then the chemicals amount flowing from the chemicals tank into the adding chemicals tank is 150−120=30 Kg.

It is apparent that the chemicals amount discharged into the adding chemicals tank can be saved before starting to add the liquid every time by the method of controlling adding liquid.

Then, the process proceeds to the immersing step (c), that is, the chemicals of which the chemicals amount has been determined in said measuring step (b) are pumped into the washer extractor, and the inner-drum in the washer extractor is kept to rotate a predetermined time, and immersing of the garment in the washer extractor is performed. In the step, preferably the inner-drum in the machine can rotate alternately in forward and backward direction, such that the garment can be immersed more evenly, thereby the effect of immersing can be improved.

Last, the process proceeds to the equal wetting step (d), that is, the inner-drum in the washer extractor is kept to rotate at high speed such that the centrifugal force produced at the high speed rotary can extract the surplus chemicals in the clothing, when the extracted surplus chemicals amount reaches the value calculated by the set wet pick up ratio, the extracting will stop, in the step of the garment equal wetting, the degree of the garment equal wetting can be controlled by controlling the extracted chemicals amount. The surplus chemicals amount extracted from the machine can be calculated by subtracting the chemicals amount absorbed by the garment which was calculated based on the wet pick up ratio from the chemicals amount added therein. That is:

The chemicals amount absorbed by the garment=the chemicals amount added in the washer extractor−the surplus chemicals amount extracted from the machine (2)

For example, if the chemicals amount absorbed by the garment is 25 Kg, and the chemicals total amount added in the washer extractor is 150 Kg, then the surplus chemicals amount extracted from the machine is 150−25=125 Kg.

Therefore, the degree of the garment equal wetting can be obtained based on the chemicals amount in the surplus chemicals tank measured by the second measuring apparatus. That is to say, when the chemicals amount in the surplus chemicals tank reaches the value calculated by the equation (2), the rotary of the inner-drum in the washer extractor will stop, thereby the equal wetting process has been finished. At this time, the garment may be taken out from the washer extractor, thus one complete working cycle has been finished.

After said equal wetting step (d) is finished, preferably the surplus chemicals extracted from the machine is discharged into the adding chemicals tank, thereby the surplus chemicals is automatically recycled, and prepared to reuse in next cycle of adding a right amount of liquid.

In one alternative embodiment of the present invention, there is provided a method of adding a right amount of liquid into the adding liquid machine with presettable quantity, includes the steps of:

First, in the setting step (a'), setting the values of wet pick up ratio representing the chemicals amount to be absorbed by the garment and the bath liquid ratio representing the chemicals amount to be added into the washer extractor, and starting the machine;

Next, in the measuring step (b'), determining the time of adding the chemicals into the washer extractor based on the garment quantity and the set wet pick up ratio;

Then, in the immersing step (c'), pumping the chemicals from the adding chemicals tank into the washer extractor, when the time of adding the chemicals reaches the determined time in the step (b'), the procedure of adding the chemicals will be stopped, then the rotary inner-drum in the washer extractor will be run at the set time to make the clothing immerse in the machine;

Last, in the equal wetting step (d'), keeping the inner-drum in the washer extractor to rotate at high speed such that the centrifugal force produced at the high speed rotary can extract the surplus chemicals in the clothing, when the time of extracting reaches the value calculated by the set wet pick up ratio, the extracting will be stopped.

The difference between the method of adding a right amount of the liquid in this second embodiment and the method of the above mentioned first embodiment is that the chemicals amount adding into the machine and the degree of the garment equal wetting can be indirectly controlled by the method of controlling the time of adding the liquid and the time of extracting, thereby the step of the direct measurement of the chemicals may be omitted, that is to say, there are provided two timers taken the place of the first and the second measuring apparatus, which can indirectly compute the time of adding the chemicals into the washer extractor and the time of extracting equal wetting respectively, the adding liquid procedure and the extracting procedure will be stopped respectively when the computed time each ends, therefore, this second embodiment simplifies the configuration of the entire system.

In the above-mentioned embodiments, the washing speed can be adjusted as required, while the extracting speed also can be adjusted to be suitable for the different requirements, the aforesaid various adjusting processes are all controlled by PLC automatic program. Preferably, the first microprocessor provided in the first electric scale 3 may be the same one microprocessor as that of which is provided in the washer extractor, just only a new functional program of said first microprocessor must be programmed on the base of the primary microprocessor of the washer extractor. Moreover, the washer extractor employed in the present invention may be the conventional washer extractor, only a spray nozzle 11 for spraying chemicals therein is installed on its primary structure without needing to modify other components of the washer extractor, thereby the primary washer extractor may further have the function of processing the clothing. Alternatively, the washer extractor employed in the present invention is not limited to the conventional washer extractor, any other apparatus can be applied to said adding liquid machine with presettable quantity in the present invention as long as they can perform immersing and extracting processes. With the adding liquid machine with presettable quantity in the present invention, during the specific operation, it may refer to the following operation parameters: washing/extracting speeds are within a range from 30/60-360/700 (rpm), and the mixture time and the bath liquid ratio can be determined particularly according to various clothing.

The described above examples and embodiment modes according to the present invention are to be considered in all respects only as illustrative and not as restrictive, therefore the present invention is not limited to the specific details given in the specification, and can be changed without departing from the scope of the appended claims and the equivalents thereof.

The invention claimed is:

1. An adding liquid machine with presettable quantity, comprising:

a washer extractor, a spray apparatus which sprays chemicals on a garment therein is provided on said washer extractor;

an adding chemicals container;

a first measuring apparatus for measuring the amount of chemicals contained in said adding chemicals container;

a microprocessor;

wherein said adding chemicals container is connected fluidly with said spray apparatus through a first chemical pump;

wherein said microprocessor is operable to calculate an amount of chemicals to be sprayed inside said washer extractor based on (a) a manual input indicative of a garment quantity and (b) a predetermined bath liquid ratio; and wherein said microprocessor is operable to calculate a surplus chemicals amount discharged from said washer extractor by subtracting a chemical amount absorbed by the garment as calculated based on a wet pick up ratio from a total chemicals amount added to said washer extractor.

2. An adding liquid machine with presettable quantity as set forth in claim 1, wherein: said adding chemicals container is connected fluidly with a large capacity chemicals tank.

3. An adding liquid machine with presettable quantity as set forth in claim 1, wherein: a drainpipe in said washer extractor is connected fluidly with said adding chemicals container.

4. An adding liquid machine with presettable quantity as set forth in claim 1, wherein: a drainpipe of said washer extractor is connected fluidly with a surplus chemicals tank, said machine comprising a second measuring apparatus for measuring an amount of chemicals in said surplus chemicals tank, and said surplus chemicals tank is connected fluidly with said adding chemicals container.

5. An adding liquid machine with presettable quantity as set forth in claim 4, wherein: said first and second measuring apparatuses are electronic scales for measuring the amounts of chemicals in said adding chemicals container and said surplus chemicals tank, respectively.

6. An adding liquid machine with presettable quantity as set forth in claim 4, wherein: said surplus chemicals container is connected fluidly with said adding chemicals-container through a second chemicals pump.

7. An adding liquid machine with presettable quantity as set forth in claim 2, wherein: said large capacity chemicals tank is connected fluidly with said adding chemicals container though a third chemicals pump.

8. An adding liquid machine with presettable quantity as set forth in claim 1, wherein: a platform on which the garment to be washed can be placed is provided on said adding chemicals container so that the first measuring apparatus can measure the garment.

9. An adding liquid machine with presettable quantity as set forth in claim 8, wherein: said microprocessor calculates the chemicals amount to be sprayed inside said washer extractor based on, the measured garment quantity and the predetermined bath liquid ratio.

10. An adding liquid machine with presettable quantity as set forth in claim 9, wherein: a drainpipe of said washer extractor is connected fluidly with a surplus chemicals tank, said machine comprising a second measuring apparatus for measuring an amount of chemicals in said surplus chemicals tank, and said surplus chemicals tank is connected fluidly with said adding chemicals container.

11. An adding liquid machine with presettable quantity as set forth in claim 1, wherein: the surplus chemicals amount discharged from said washer extractor is calculated by said microprocessor by subtracting a chemicals amount absorbed by the garment as calculated based on the wet pick up ratio from a chemicals total amount added therein.

12. An adding liquid machine with presettable quantity as set forth in claim 1, wherein: the washing speed and the extractor speed of said washer extractor are adjustable.

13. An adding liquid machine with presettable quantity as set forth in claim 1, wherein: said washing/extracting speeds of said washer extractor are in a range from approximately 30/60 to approximately 360/700 revolutions per minute.

14. A method of adding a right amount of liquid into an adding liquid machine with presettable quantity including a washer extractor, a spray apparatus which sprays chemicals on a garment therein is provided on said washer extractor; a first measuring apparatus for measuring the amount of chemicals contained in an adding chemicals container; wherein said adding chemicals container is connected fluidly with said spray apparatus through a first chemical pump;

said method comprising the steps of:

(a) setting a wet pick up ratio representing the chemicals amount to be absorbed by the garment and a bath liquid ratio representing the chemicals amount to be added into the washer extractor;

(b) determining the chemicals amount added into the washer extractor based on the garment quantity and the set wet pick up ratio;

(c) pumping the chemicals of which the amount has been determined in the step (b) into the washer extractor, keeping an inner-drum in the washer extractor to rotate a predetermined time, and starting to immerse the garment in the washer extractor; and (d) keeping the inner-drum in the washer extractor to rotate at high speed such that the centrifugal force produced at the high speed rotary can extract the surplus chemicals in the clothing, when the extracted surplus chemicals amount reaches the value calculated by the set wet pick up ratio, the extracting will stop.

15. A method as set forth in claim 14, further includes: in step (b), said first measuring apparatus measures the weight of said clothing, and determines the required chemicals amount to be filled in the machine automatically based on the set wet pick up ratio.

16. A method as set forth in claim 14, wherein the surplus chemicals amount extracted from the washer extractor is calculated by subtracting the chemicals amount absorbed by the garment as calculated based on the wet pick up ratio from the chemicals total amount added therein.

17. A method as set forth in claim 16, further includes the step of discharging the surplus chemicals extracted from the machine into the adding chemicals container.

18. A method as set forth in claim 17, wherein the determined chemicals amount to be filled in the machine in the step (b) contains the chemicals discharged from the surplus chemicals tank into the adding chemicals container during the adding a right amount liquid last time.

19. A method as set forth in claim 14, wherein the inner-drum in the washer extractor is rotatable alternately in a forward direction and a backward direction in the step (c).

20. A method of adding a right amount of liquid into an adding liquid machine with presettable quantity including a washer extractor, a spray apparatus which sprays chemicals on a garment therein is provided on said washer extractor; a first timer which is provided to compute the time of adding chemicals into the washer extractor; wherein an adding chemicals container is connected fluidly with said spray apparatus through a first chemical pump;

said method comprising the steps of:

(a') setting a wet pick up ratio representing the chemicals amount to be absorbed by the garment and a bath liquid ratio representing the chemicals amount to be added into the washer extractor;

(b') determining the time of adding the chemicals into the washer extractor based on the garment quantity and the set wet pick up ratio;

(c') pumping the chemicals from the adding chemicals tank into the washer extractor, when the time of adding the chemicals reaches the determined time in the step (b), the procedure of adding the chemicals will be stopped, then a rotary inner-drum in the washer extractor will be run at the set time to make the clothing immerse in the washer extractor;

(d') keeping the inner-drum in the washer extractor to rotate at high speed such that the centrifugal force produced at the high speed rotary extracts the surplus chemicals in the clothing, when the time of extracting reaches the value calculated by the set wet pick up ratio, the extracting will be stopped.

21. A method as set forth in claim 20, further includes the step of discharging the surplus chemicals extracted from the machine into the adding chemical container.

* * * * *

UNITED STATES PATENT AND TRADEMARK OFFICE

CERTIFICATE OF CORRECTION

PATENT NO. : 7,549,184 B2
APPLICATION NO. : 10/555823
DATED : June 23, 2009
INVENTOR(S) : Yu-Gao Zhang It is certified that error appears in the above-identified patent and that said Letters Patent is hereby corrected as shown below:

Column 9
Claim 7, Line 62, "though" should be --through--

Signed and Sealed this

Twenty-second Day of September, 2009

David J. Kappos

David J. Kappos
*Director of the United States Patent and Trademark Office*